US007481210B2

(12) United States Patent
Kim et al.

(10) Patent No.: US 7,481,210 B2
(45) Date of Patent: Jan. 27, 2009

(54) GAS RANGE

(75) Inventors: Young Soo Kim, Gyeongsangnam-do (KR); Dae Hee Jung, Gyeongsangnam-do (KR); Dae Rae Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 562 days.

(21) Appl. No.: 11/126,290

(22) Filed: May 11, 2005

(65) Prior Publication Data

US 2006/0076005 A1 Apr. 13, 2006

(30) Foreign Application Priority Data

Oct. 12, 2004 (KR) ..... 10-2004-0081275
Oct. 12, 2004 (KR) ..... 10-2004-0081276

(51) Int. Cl.
*F24C 15/08* (2006.01)
*F24C 15/10* (2006.01)

(52) U.S. Cl. ..... 126/39 B; 126/214 R

(58) Field of Classification Search ..... 126/214 R, 126/39 B, 39 E, 91 R; 431/326, 354
See application file for complete search history.

(56) References Cited

U.S. PATENT DOCUMENTS 3,698,378 A * 10/1972 Rosenberg et al. ..... 126/39 R
5,400,765 A * 3/1995 Goldstein et al. ..... 126/39 J
6,349,714 B1 * 2/2002 Hurley et al. ..... 126/39 J

FOREIGN PATENT DOCUMENTS

EP 1467153 A1 10/2004
GB 1210478 10/1970
GB 2267750 A 12/1993
KR WO 2004/051145 6/2004

* cited by examiner

*Primary Examiner*—Alfred Basichas
(74) *Attorney, Agent, or Firm*—Ked & Associates, LLP

(57) ABSTRACT

Gas range including a casing having an inlet for drawing external air, and an outlet for discharging exhaust gas, at least one burner each having a burner mat for being heated with flame formed at the time of combustion of fuel gas to generate radiant heat, a sheet of glass covered on each of the burners for transmission of the radiant heat, and a first fan provided at the outlet for discharging the exhaust gas to an outside of the gas range, and drawing the external air into the casing.

15 Claims, 5 Drawing Sheets

GAS RANGE

CROSS-REFERENCE TO RELATED APPLICATIONS

This application claims the benefit of Korean Application Nos. P2004-81275, and P2004-81276 both filed on Oct. 12, 2004, which are hereby incorporated by reference as if fully set forth herein.

BACKGROUND OF THE INVENTION

1. Field of the Invention

The present invention relates to gas ranges, and more particularly, to a gas range which heats food with radiant heat.

2. Discussion of the Related Art

In general, the gas range heats food with heat generated when a mixed gas of fuel gas and air burns.

For this, the gas range is provided with an oven unit, a grill unit, and a top unit. The oven unit barbecues or bakes bread with convective heat, and grill unit over the oven unit broil fish, or the like with radiant heat.

The top unit at the top of the gas range heats food directly with flame formed when the gas burns. To do this, there is a burner under the top unit for burning the fuel gas.

In the meantime, because the top unit heats food with the flame formed when the fuel gas burns directly, the related art gas range has a problem in that the radiant heat generated at the time of combustion of fuel gas can not be used. Consequently, development of a technology for effective use of the radiant heat from the burner is required.

SUMMARY OF THE INVENTION

Accordingly, the present invention is directed to a gas range that substantially obviates one or more problems due to limitations and disadvantages of the related art.

An object of the present invention is to provide a gas range with a radiant burner which makes a stable operation.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a gas range includes a casing having an inlet for drawing external air, and an outlet for discharging exhaust gas, at least one burner each having a burner mat for being heated with flame formed at the time of combustion of fuel gas to generate radiant heat, a sheet of glass covered on each of the burners for transmission of the radiant heat, and a first fan provided at the outlet for discharging the exhaust gas to an outside of the gas range, and drawing the external air into the casing.

The casing has an inside space divided by a burner housing in communication with the outlet, and the burners are under the burner housing. The burner includes a burner pot under the burner housing to form a space for burning fuel gas therein, the burner pot having an upper surface with the burner mat fixedly secured thereto, a mixing tube at one side of the burner pot for receiving, and mixing the gas and the air, and a gas supply tube for supplying the gas to the mixing tube.

The gas supply tube is spaced away a predetermined distance from the mixing tube. The burner housing has at least one communication hole for pass of the external air. The gas range further includes an exhaust duct connected to the outlet for guiding the exhaust gas to an outside of the gas range.

Preferably, the first fan is a cross flow fan. A motor for driving the first fan is a variable speed motor of which rotation speed varies with a gas supply rate to the burner. A motor for driving the first fan is a variable speed motor of which rotation speed varies with a number of the burners in operation.

The gas range further includes a supply duct for making an inside of the casing in communication with an outside of the gas range to supply fresh air to the burners.

In another aspect of the present invention, a gas range includes a casing having an inlet for drawing external air, and an outlet for discharging exhaust gas, at least one burner each having a burner mat for being heated with flame formed at the time of combustion of fuel gas to generate radiant heat, a sheet of glass covered on each of the burners for transmission of the radiant heat, a supply duct for guiding external air to an inside of the casing, a mixing tube having one end connected to the supply duct, and the other end in communication with the burner, for supplying the external air to the burner, and a second fan for blow air to guide the external air to the inside of the casing.

The casing has an inside space divided by a burner housing in communication with the outlet, and the burners are under the burner housing.

The burner includes a burner pot under the burner housing to form a space for burning fuel gas therein, the burner pot having one side connected to the mixing tube, and an upper surface with the burner mat fixedly secured thereto, and a gas supply tube connected to one side of the mixing tube for supplying the gas thereto.

The mixing tube is connected to burners with gas burning capacities greater than a predetermined capacity. The gas range further includes a control valve mounted in the mixing tube for controlling an air supply rate to the burner. The control valve is a solenoid valve selectively opened when the burner is operated.

The control valve is opened in multiple stages according to the gas supply flow rate to the burner. The supply duct has one end connected to an outfit room at a front of the casing.

In another aspect of the present invention, a gas range includes a casing having an inlet for drawing external air, and an outlet for discharging exhaust gas, at least one burner each having a burner mat for being heated with flame formed at the time of combustion of fuel gas to generate radiant heat, a sheet of glass covered on each of the burners for transmission of the radiant heat, a supply duct for guiding external air to an inside of the casing, a mixing tube having one end connected to the supply duct, and the other end in communication with the burner, for supplying the external air to the burner, a second fan for blow air to guide the external air to the inside of the casing, and a first fan at the outlet for discharging exhaust gas to an outside of the gas range, and drawing the external air into an inside of the casing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The gas range of the present invention employs a radiant gas burner which heats a heating object with radiant heat from a heated radiant body.

Figure 1:
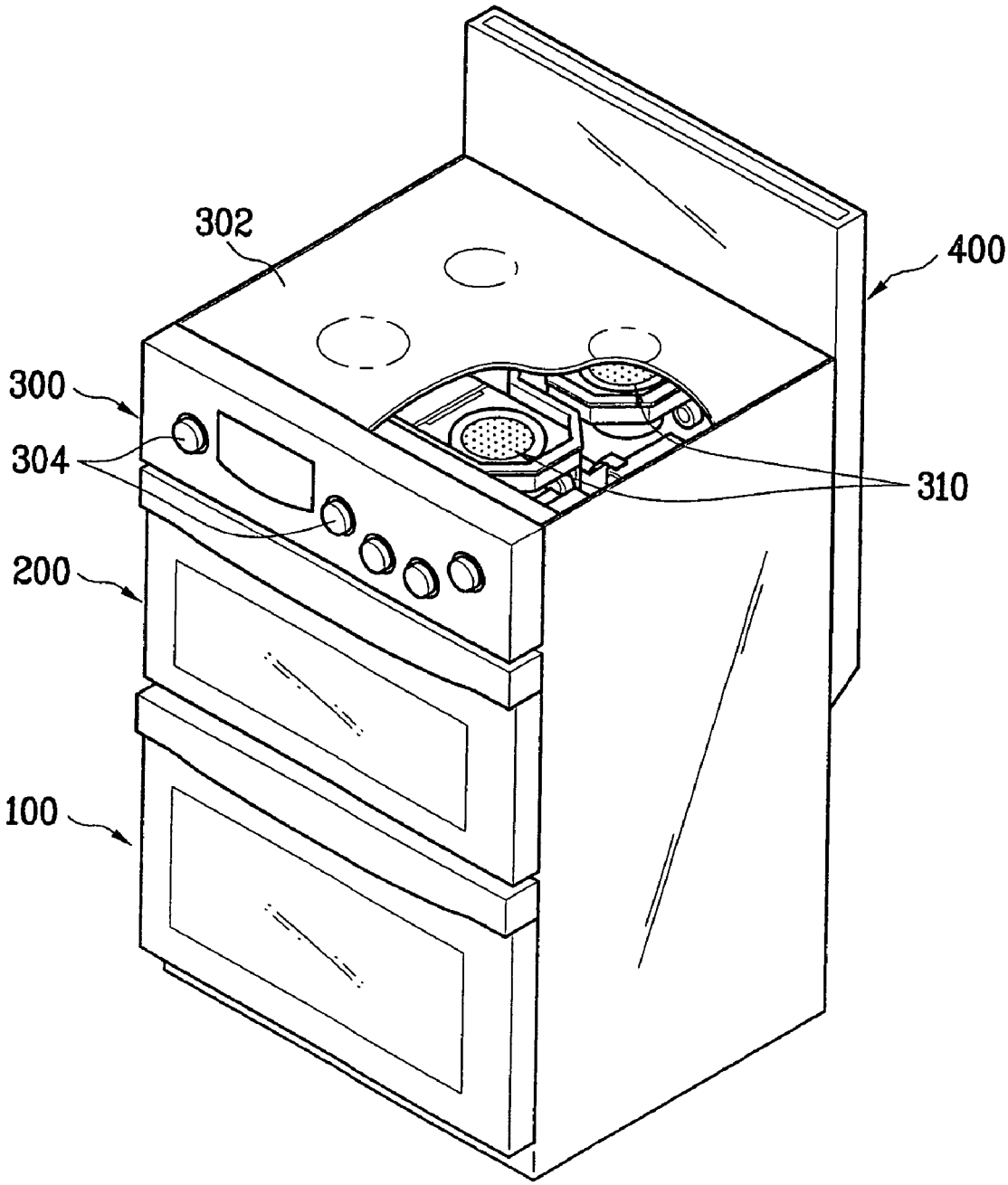
FIG. 1 illustrates a perspective view of a gas range of the present invention.

A gas range in accordance with a preferred embodiment of the present invention will be described, with reference to FIGS. 1 to 6. FIG. 1 illustrates a perspective view of a gas range of the present invention.

Referring to FIG. 1, the gas range includes an oven unit 100, a grill unit 200, and a top burner unit 300.

The oven unit 100 cooks food, such as barbecue or bread, with convective heat, and the grill unit 200 over the oven unit 100 broils fish, or the like. The top burner unit 300 over the grill unit 200 heats food or a container containing food.

The top burner unit 300 has at least one burner 310 therein, and a sheet of glass 302 over the burner 310 for transmission of radiant heat. Preferably, the sheet of glass 302 is formed of ceramic having good light transmittivity and high heat resistance.

At a front of the top burner unit 300, there is an outfit unit (not shown) having electronic components inclusive of a microcomputer (not shown) mounted therein for operating the burner 310.

On a front surface of the outfit unit, there is knobs 304 for adjusting thermal power supplied to the gas oven range. That is, a flow rate of the fuel gas supplied to the burner 310 is adjusted with the knobs 304.

Figure 2:
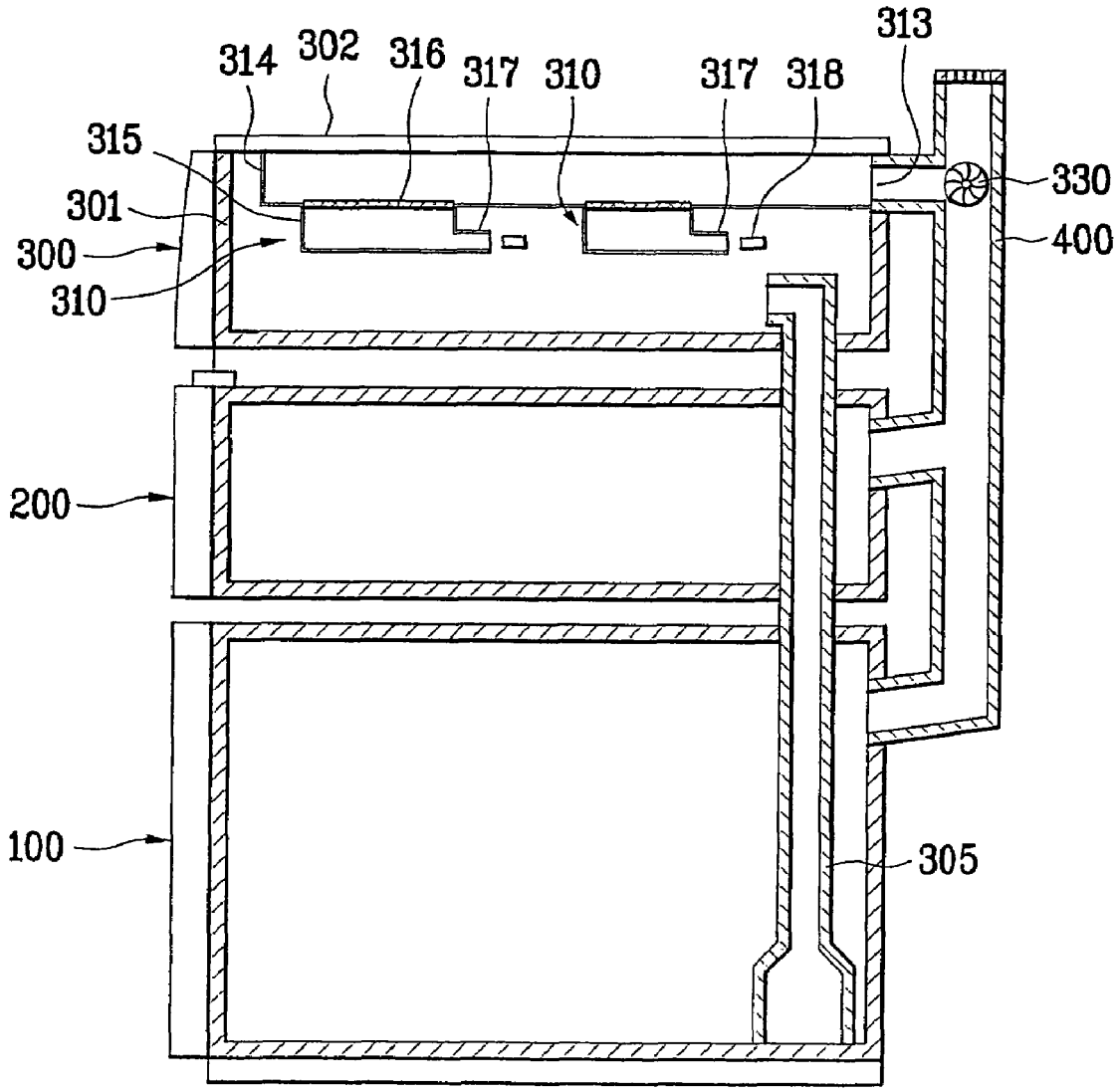
FIG. 2 illustrates a section of a gas range in accordance with a first preferred embodiment of the present invention.
Figure 3:
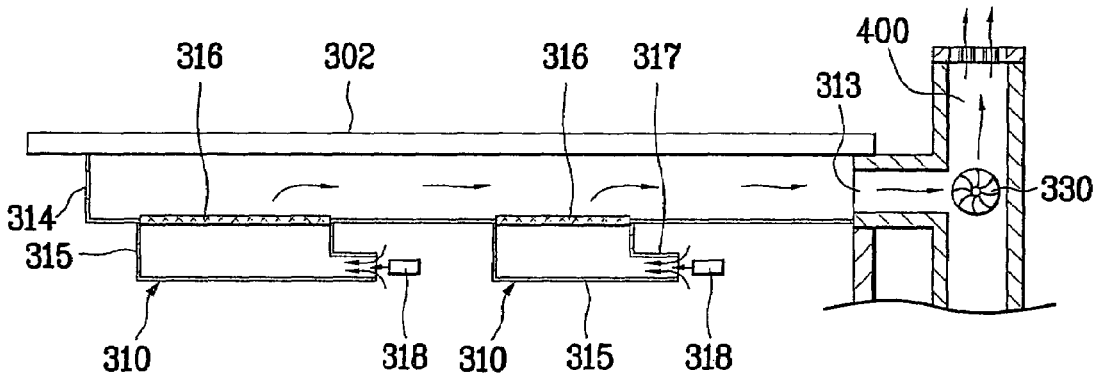
FIG. 3 illustrates a section of a burner of the gas range in accordance with a first preferred embodiment of the present invention.

FIG. 2 illustrates a section of a gas range in accordance with a first preferred embodiment of the present invention, and FIG. 3 illustrates a section of a burner of the gas range in accordance with a first preferred embodiment of the present invention.

Referring to FIG. 2, in rear of the gas range, there is an exhaust duct 400 in communication with the oven unit 100, the grill unit 200, and the top burner unit 300, for discharging exhaust gas therefrom to an outside of the gas range.

There are a plurality of burners 310 in the casing 301 of the top burner unit. 300.

Referring to FIG. 3, the casing 310 has an inside space divided with a burner housing 314, and there is at least one burner under the burner housing 314. The burner 310 includes a burner mat 316, a mixing tube 317, and a gas supply tube 318.

In a burner pot 315, there is a combustion space for mixing and burning the gas and air, and on the burner pot 315, there is a burner mat 316 fixedly secured to the burner pot 315. The mixing tube 317 is at one side of the burner pot 315, for receiving and mixing the fuel gas and air. The gas supply tube 318 is at a position spaced a predetermined distance away from the mixing tube 317 for spraying the fuel gas into the mixing tube 317.

Therefore, the flame formed when the fuel gas burns heats the burner mat 316, when the burner mat 316 emits radiant heat which passes through the glass sheet 302 and heats food. It is preferable that the burner mat 316 is constructed of mesh of thin wires.

The mixing tube 317 is at one side of the burner pot 315 for receiving and mixing gas and air from an outside of the gas range. The gas supply tube 318 is at a position spaced a predetermined distance away from the mixing tube 317, for spraying gas into the mixing tube 317.

For smooth combustion of the fuel gas in the burner 310, it is required to blow air required for burning to the top burner unit 300. To do this, the casing 301 has an inlet for receiving external air required for burning the fuel gas, and an outlet 313 for discharging combustion gas produced after combustion of the fuel gas. It is preferable that the inlet and the outlet 313 are in communication with the space divided with the burner housing 314.

In more detail, the inlet in the casing 310 has a supply duct 305 which is in communication with an outside of the gas range connected thereto, for introduction of an external air into the casing 301 through the supply duct 305. It is preferable that one end of the supply duct 305 is extended from the top burner unit 300 to a lower portion of the gas oven range. The outlet 313 is connected to the exhaust duct 400 for guiding the exhaust gas to an outside of the gas range.

The operation of the gas oven range in accordance with the first embodiment of the present invention will be described with reference to FIGS. 1 to 3.

When the user places food on the glass sheet 302 and puts the burner 310 into operation, the fuel gas is sprayed into the mixing tube 317 through the gas supply tube 318 at a high speed. In this instance, since a pressure at an end of the mixing tube 317 drops according to the Bernoulli's theorem, air in the vicinity of the end is drawn into, and mixed with air in the mixing tube 317.

At the same time with this, the mixture gas having the fuel gas and the air mixed therein is ignited with an igniting spark generated at a igniter (not shown), and burns. The flame from the burning heats the burner mat 316 on the burner pot 315, such that the burner mat 316 emits radiant heat. The radiant heat transmits through the glass sheet 302 and reaches to, and heats the food.

In the meantime, the exhaust gas produced after the gas burns is discharged to an outside of the gas range through the exhaust duct 400 in communication with the burner housing 314. Since an upper surface of the burner 310 is covered with the glass sheet 302, there may be shortage of air supplied from an outside of the gas range. In order to prevent this, though a fan may be mounted in the supply duct 305, for forced supply of air to the top burner unit 300, a portion of the air can be leaked through a gap between the burner pot 315 and the burner housing 314.

In order to prevent this, it is preferable that a first fan 330 is mounted on an outlet 313 side in the casing 310 for blowing the exhaust gas to an outside of the gas range, and drawing external air into the burner pot. It is preferable that the first fan 330 is a cross flow fan constructed lengthwise along a section of the duct having, in general, a rectangular section.

In this instance, the outlet 313 has the exhaust duct 400 connected thereto, and the exhaust duct 400 is connected, not only to the top burner unit 300, but also to the grill unit 200, and the oven unit 100. Therefore, it is preferable that the first fan is mounted at a point where gas discharge flow passages of the top burner unit 300, the grill unit 200, and the oven unit 100 are met, for drawing and discharging all the combustion gas produced from the units 300, 200, and 100 to an outside of the gas range.

The first fan 330, not only discharges the combustion gas, but also draws external air into the casing 301, quickly. In this instance, a rotation speed of the first fan 330 may be varied for adjusting an air flow rate of the external air.

It is preferable that a motor (not shown) of the first fan 330 is a BLDC motor (Brushless DC Motor) of which rotation speed is variable so that the user can adjust the gas supply rate. This is because the air flow rate required for combustion of the mixture gas is proportional to the gas supply rate. According to this, the rotation speed of the first fan 330 is adjusted according to operation of the burner 310, to adjust the air flow rate being drawn.

Therefore, if the first fan 330 in the exhaust duct 400 rotates during the burner 310 is operated, the external air can be drawn smoothly into the burner 310 additionally through the mixing tube 317 of the burner 310, and mixed with the gas.

It is preferable that the rotation speed of the first fan 330 is varied with a number of the burners 310 under operation by a control unit electrically connected to flame sensors or igniters.

That is, in a case only one of the burners 310 is operated, the rotation speed of the first fan 330 is reduced, to reduce the air flow rate, and opposite to this, in a case 3~4 burners 310 are operated at the same time, the rotation speed of the first fan 330 is increased to increase the air flow rate.

In the meantime, the rotation speed of the first fan 330 may be varied with the gas flow rate supplied to the burner 310.

In more detail, since an air flow rate required for combustion increases, if the user adjusts the knob in a direction supply of the gas increases, it is preferable that the rotation speed of the fan 330 increases. Opposite to this, since an air flow rate required for combustion decreases, if the user adjusts the knob in a direction supply of the gas decreases, it is preferable that the rotation speed of the fan 330 decreases.

In the meantime, the first fan 330 serves to draw external air, as well as to discharge high temperature combustion gas from the burner housing 314 to an outside of the gas range, quickly. According to this, overheating of the burner 310 is prevented, and smooth introduction of air into the burner 310 is enabled.

Figure 4:
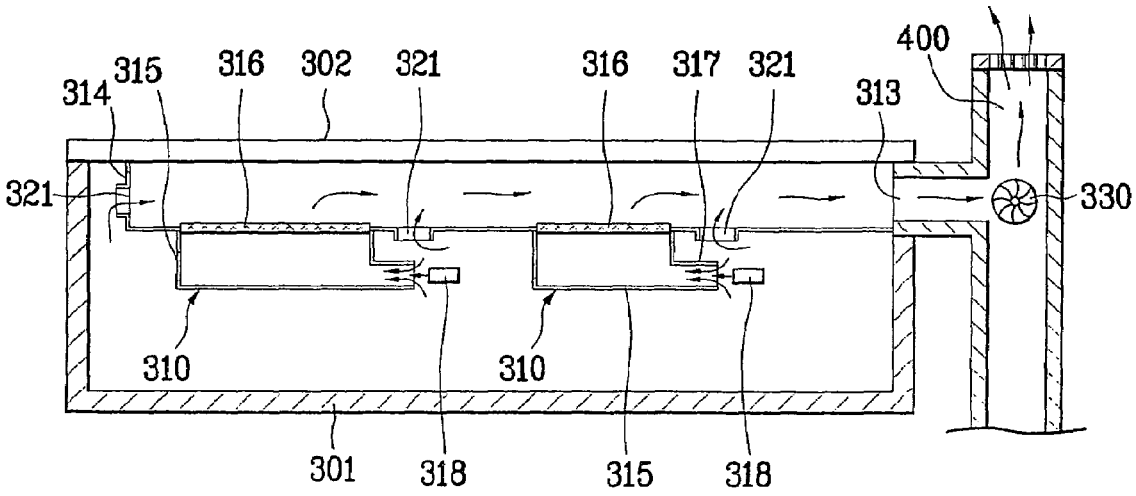
FIG. 4 illustrates a section of a burner of the gas range in accordance with a second preferred embodiment of the present invention.

In the meantime, FIG. 4 illustrates a section of a burner of the gas range in accordance with a second preferred embodiment of the present invention.

Referring to FIG. 4, basically, the gas range of this embodiment has the same system and operation with the foregoing first embodiment gas range, except that the burner housing 314 has a plurality of communication holes 321 formed therein, for drawing air through the communication holes 321 additionally when the first fan 330 is driven.

The additional drawing of air through the communication hole 321 in the burner housing 314 enables to supply an adequate amount of air the each burners even if the rotation speed of the first fan is made low.

A gas range in accordance with a third preferred embodiment of the present invention will be described.

Figure 5:
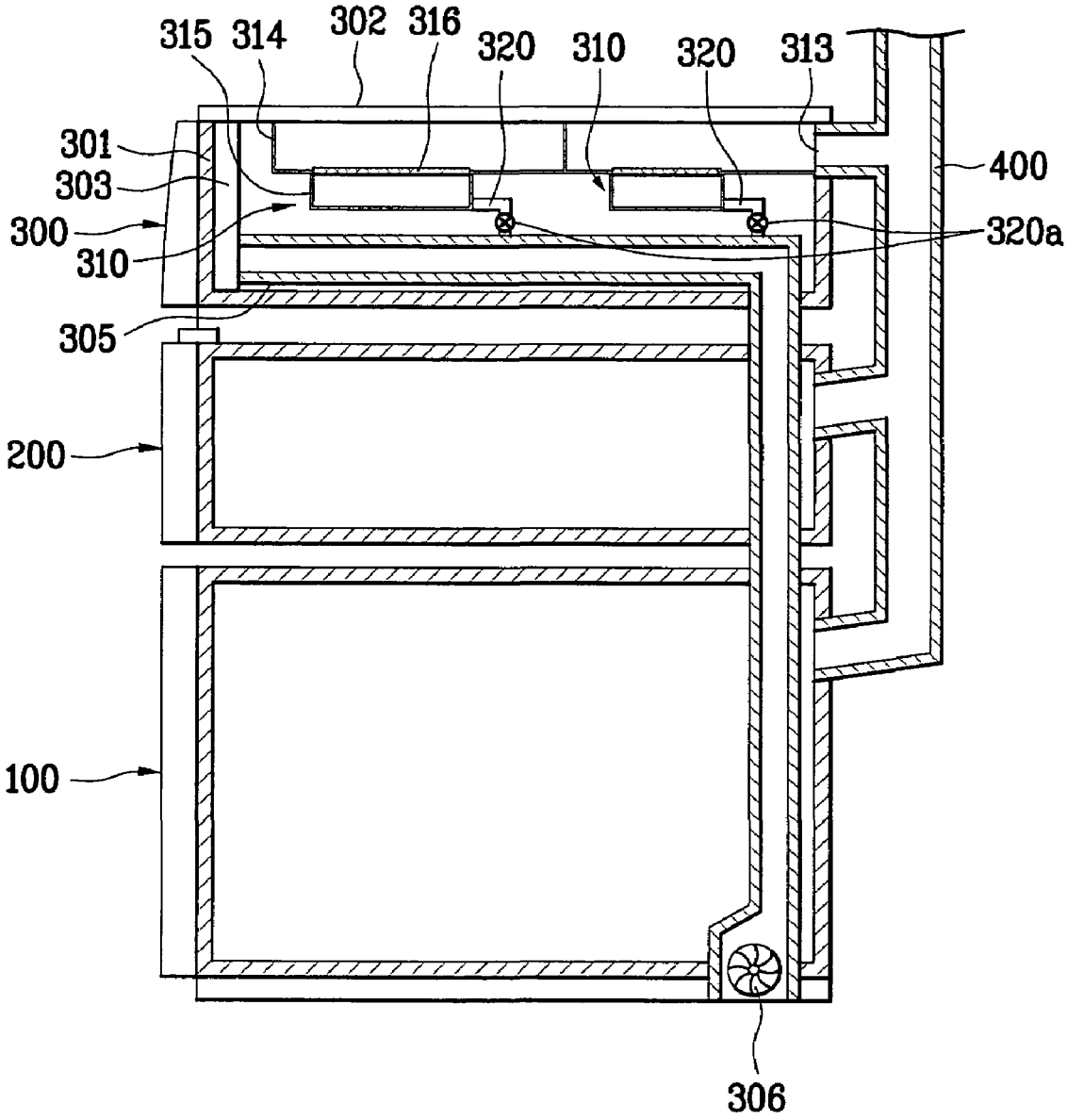
FIG. 5 illustrates a section a gas range in accordance with a third preferred embodiment of the present invention.
Figure 6:
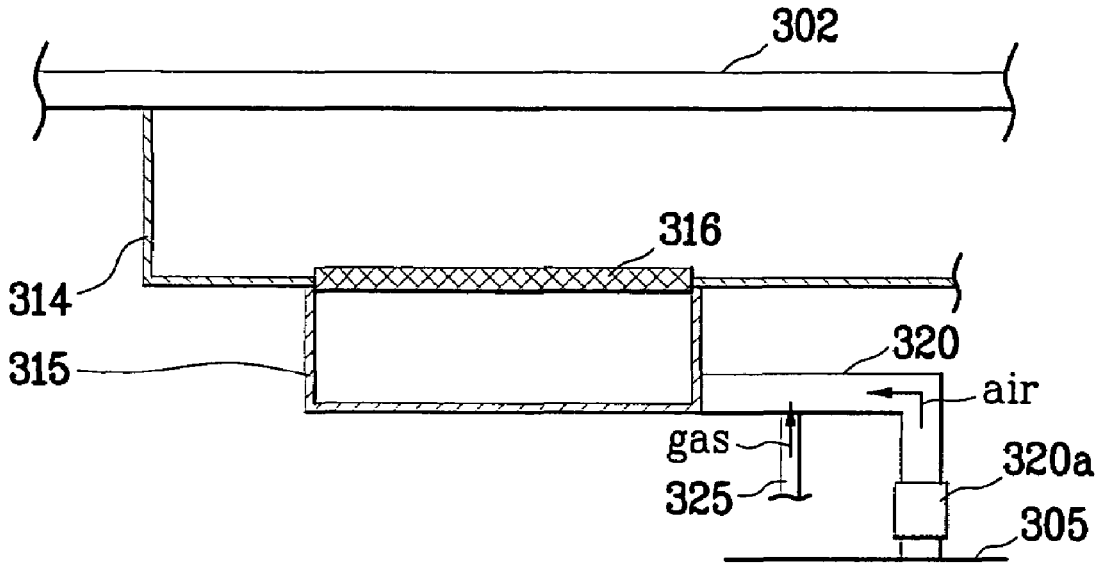
FIG. 6 illustrates a section of a burner of the gas range in accordance with the third preferred embodiment of the present invention.

FIG. 5 illustrates a section a gas range in accordance with a third preferred embodiment of the present invention, and FIG. 6 illustrates a section of a burner of the gas range in accordance with the third preferred embodiment of the present invention.

Referring to FIG. 5, basically, the gas range of this embodiment has the same system and operation with the foregoing first embodiment gas range, except that a supply duct 305 is mounted in the casing 301 of the top burner unit 300 for guiding introduction of external air. The supply duct 305 has one end in communication with an outside of the gas range through a bottom of the gas range, and the other end connected to the outfit unit mounted at a front of the top burner unit 300.

The supply duct 305 has a second fan 306 and a motor mounted therein for blowing external air. It is preferable that the supply duct 305 is mounted at opposite sides of the gas range, along with the second fans 306 mounted in each of the supply ducts 305.

In the meantime, the supply duct 305 has an extension in the casing 301 where the mixing tubes 320 are connected, and it is preferable that the mixing tubes 320 are provided in correspondence to the burners 310.

Moreover, it is preferable that one end of the supply duct is connected to an outfit room 303 at the front of the top burner portion 300, for blowing a portion of external air to the outfit room 303, for dissipating heat from the outfit room 303.

The external air drawn through the supply duct 305 is supplied to the burners 310 through the mixing tube 320. There is a gas supply tube 325 connected to one side of the mixing tube 320 for supplying fuel gas, so that the fuel gas is mixed with external air supplied through the supply duct 305, and supplied to the burner 310.

It is preferable that the mixing tube 320 has a control valve **320*a* mounted therein for controlling a flow rate of the air supplied through the supply duct 305, and the control valve 320*a*** is solenoid valve for opening/closing the flow passage, electrically.

Accordingly, if the user adjusts the gas flow rate supplied to the burner 310 by using the knob, the control valve **320*a* is opened or closed in response to an electric signal generated at the microcomputer, accordingly. It is preferable that the control valve 320*a*** has an extent of opening varied in many steps in correspondence to changes of the gas flow rate following handling of the knob.

In the meantime, in a case the control valve **320*a* simply performs a function of opening/closing the flow passage only, the rotation speed of the second fan 306 may be changed for adjusting the air flow rate into the burner 310. That is, the rotation speed of the second fan 306 may be changed according to the flow rate of fuel gas supplied to the burner 310**.

For this, it is preferable that the second fan 306 has a BLDC motor (brushless DC motor) mounted thereon, for varying a speed.

The operation of the gas range in accordance with this embodiment will be described.

When the user places cooking object on the glass sheet 302 of the top burner unit 300, and turns the knob of the burner 310, the second fan 306 is driven by the microcomputer, to blow external air into the supply duct 305.

At the same time with this, when the control valve **320*a* in the mixing tube 320 connected to the burner 310 is opened, external air supplied through the supply duct 305 is introduced into the burner pot 315. In this instance, the air is mixed with the fuel gas introduced through the gas supply tube 325, before being introduced into the burner pot 315**.

The fuel gas is ignited by a spark from the igniter or a flame detecting rod, and the burner mat 316 is heated with the flame formed in this time, to emit radiant heat.

If the user adjusts the knob to change the fuel gas supply rate in the middle of heating the food with the radiant heat, the extent of opening of the control valve 320*a* changes, to change the air supply rate.

Of course, other than change of the extent of opening of the control valve 320*a*, the air supply rate can be changed by changing the rotation speed of the second fan 306.

In the meantime, if the plurality of burners 310 have different capacities, diameters, or a number of the mixing tubes 320 connected to the supply duct 305 may differ. Or, the mixing tube 320 may be only connected to large capacity burners each with a capacity greater than a predetermined capacity, to supply external air thereto through the supply duct 305.

Alike the first embodiment, the embodiment may have the first fan mounted at the outlet of the casing 301, for supplying more external air.

As has been described, the gas range of the present invention has the following advantages.

First, food can be cooked with the high efficiency radiant heat from the burner mat heated by flame formed at the time of combustion of the fuel gas.

Second, the drawing of external air into the burner by using the first fan at the outlet, instead of pushing in the external air into the burner, enables to supply an adequate amount of the external air to the burner. That is, the leakage of the external air through the gap between the burner housing and the burner pot caused by a pressure inside of the burner can be prevented.

Third, the quick discharge of high temperature exhaust gas by using the first fan prevents the burner from being overheated, excessively.

Fourth, the connection of one end of the supply duct to the outfit room enables efficient heat dissipation from the components in the outfit room.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A gas range, comprising:

a casing having an inlet for drawing in external air, and an outlet for discharging exhaust gas, and including an outfit room located at a front of a burner unit, the outfit room containing electrical components that control the gas range;

at least one burner, wherein each burner includes a burner mat that is heated with a flame formed by the combustion of fuel gas, to thereby generate radiant heat;

a sheet of glass mounted over each at least one burner;

a supply duct that guides external air from the inlet to a position inside of the casing adjacent the at least one burner, wherein an end of the supply duct is connected to the outfit room;

at least one mixing tube, wherein at least one mixing tube is provided for each at least one burner, wherein each mixing tube has one end connected to the supply duct, and the other end in communication with a burner, and wherein each mixing tube also receives fuel gas from a gas supply tube; and an air supply fan mounted in the supply duct.

2. The gas range as claimed in claim 1, wherein the casing has an inside space that includes a burner housing in communication with the outlet, and wherein the at least one burner is located in the burner housing.

3. The gas range as claimed in claim 2, wherein each at least one burner comprises:

a burner pot that forms a space for burning fuel gas therein, the burner pot having one side connected to at least one mixing tube; and a burner mat fixedly secured to an upper portion of the burner pot.

4. The gas range as claimed in claim 1, wherein multiple mixing tubes are connected to each at least one burner that has a gas burning capacity greater than a predetermined capacity.

5. The gas range as claimed in claim 1, further comprising at least one control valve, wherein a control valve is coupled to each at least one mixing tube, and wherein each control valve controls a flow rate of external air supplied to its associated mixing tube.

6. The gas range as claimed in claim 5, wherein the at least one control valve is a solenoid valve that is selectively opened when an associated burner is operated.

7. The gas range as claimed in claim 6, wherein the at least one control valve is opened in multiple stages to selectively vary the amount of external air supplied to an associated mixing tube based on a flow rate of combustion gas being supplied to the associated mixing tube.

8. The gas range as claimed in claim 1, wherein a rotational speed of the air supply fan is varied to vary a flow rate of external air supplied to the at least one mixing tube.

9. The gas range as claimed in claim 1, further comprising an exhaust fan that blows exhaust gases out of the outlet.

10. The gas range as claimed in claim 1, wherein the exhaust fan also causes external air to be drawn into the casing.

11. The gas range as claimed in claim 1, wherein external air is supplied to the outfit room through the supply duct to cool the electrical components located in the outfit room.

12. A gas range, comprising:

a casing having an inlet for drawing in external air, and an outlet for discharging exhaust gas and including an outfit room located at a front of a burner unit, the outfit room containing electrical components that control the gas range;

at least one burner, wherein each burner includes a burner mat that is heated with a flame formed by the combustion of fuel gas, to thereby generate radiant heat;

a sheet of glass mounted over each at least one burner;

a supply duct that guides external air from the inlet to a position inside of the casing adjacent the at least one burner, wherein an end of the supply duct is connected to the outfit room;

at least one mixing tube, wherein at least one mixing tube is provided for each at least one burner, wherein each mixing tube has one end connected to the supply duct, and the other end in communication with a burner, and wherein each mixing tube also receives fuel gas from a gas supply tube;

an air supply fan that blows air through the supply duct; and an exhaust fan at the outlet for discharging exhaust gas to an outside of the gas range, and that also operates to draw external air into an inside of the casing.

13. The gas range as claimed in claim 12, wherein a rotational speed of the air supply fan is varied to vary a flow rate of external air supplied to the at least one mixing tube.

14. The gas range as claimed in claim 12, wherein a rotational speed of the exhaust fan is varied to vary a flow rate of external air supplied to the at least one mixing tube.

15. The gas range as claimed in claim 12, wherein external air is supplied to the outfit room through the supply duct to cool the electrical components located in the outfit room.

* * * * *